United States Patent [19]

Iten

[11] Patent Number: 4,833,779

[45] Date of Patent: May 30, 1989

[54] PLATFORM, HANDLE AND SHIELD FOR SAFETY RAZOR

[75] Inventor: Clemens A. Iten, Fisherville, Va.

[73] Assignee: American Safety Razor Company, Verona, Va.

[21] Appl. No.: 67,800

[22] Filed: Jun. 30, 1987

[51] Int. Cl.[4] ..... B26B 21/14

[52] U.S. Cl. ..... 30/47; 30/90

[58] Field of Search ..... 30/32, 47, 50, 85, 90

[56] References Cited

U.S. PATENT DOCUMENTS

| | | | |
|---|---|---|---|
| D. 224,852 | 9/1972 | Dorion, Jr. | D95/3 |
| D. 242,661 | 12/1976 | Gray | D28/3 |
| 3,172,202 | 3/1965 | Sooter | 30/90 |
| 3,388,468 | 6/1968 | Hamill | 30/90 |
| 3,703,764 | 11/1972 | Perry | 30/32 |
| 3,724,070 | 4/1973 | Dorion, Jr. | 30/47 |
| 3,768,162 | 10/1973 | Perry | 30/47 |
| 3,786,563 | 1/1974 | Dorion, Jr. et al. | 30/50 |
| 4,037,321 | 7/1977 | Iten et al. | 30/47 |
| 4,587,730 | 5/1986 | Iten | 30/90 |
| 4,612,704 | 9/1986 | Berretti | 30/47 |
| 4,739,553 | 4/1988 | Lazachik | 30/47 |

FOREIGN PATENT DOCUMENTS

| | | |
|---|---|---|
| 1377134 | 12/1974 | United Kingdom . |
| 2066134 | 7/1981 | United Kingdom . |
| 2193460 | 2/1988 | United Kingdom . |

*Primary Examiner*—Frank T. Yost
*Assistant Examiner*—Michael D. Folkerts
*Attorney, Agent, or Firm*—Nixon & Vanderhye

[57] ABSTRACT

A safety razor having a handle carrying a head having two projecting tongues, a platform having a pair of undercut recesses for receiving the tongues and a shield for overlying the razor blade head. The platform includes along its underside a retaining edge opposite the undercuts, a pair of centering ribs spaced one from the other and with tapered edges for engaging the end edges of the handle head, and a pair of crush ribs adjacent the undercuts to bias the head and platform away from one another in final securement. To assemble the safety razor, the handle head tongues are inserted into the undercuts and the handle is pivoted to seat the back edge of its head beneath the underside of the platform edge. The pivoting action causes the handle end edges to bear against the tapered centering ribs centering the handle relative to the platform and the crush ribs to engage the head to afford a tight fit. The shield is generally channel-shaped and has angled end edges and lugs at each of the opposite corners for engaging in chamfers formed along the underside of the platform to facilitate centering of the shield on the platform.

14 Claims, 3 Drawing Sheets

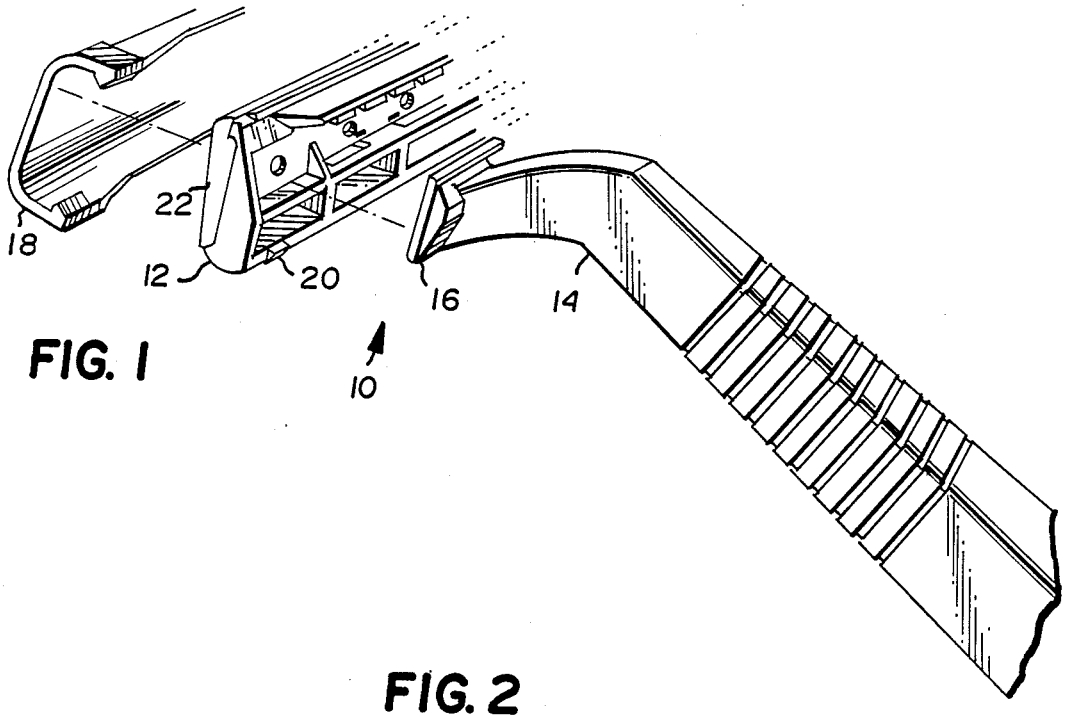
FIG. 1
FIG. 2
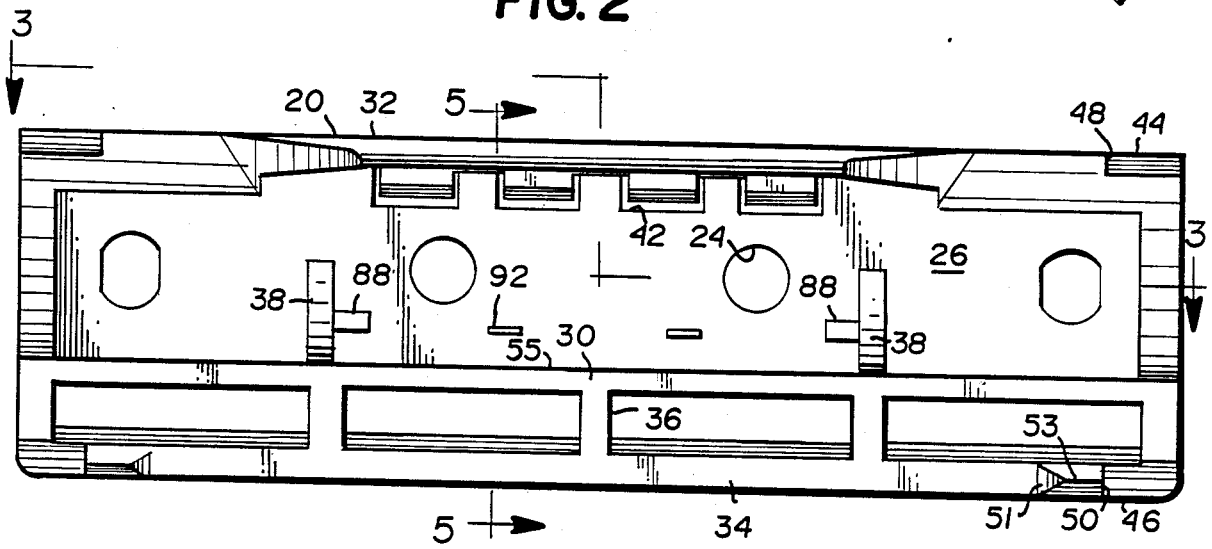
FIG. 3
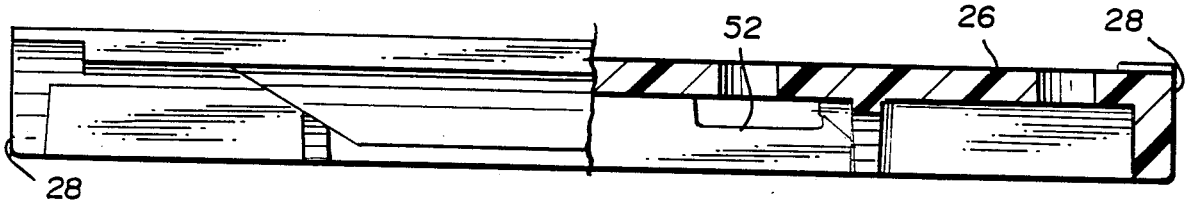

FIG. 4
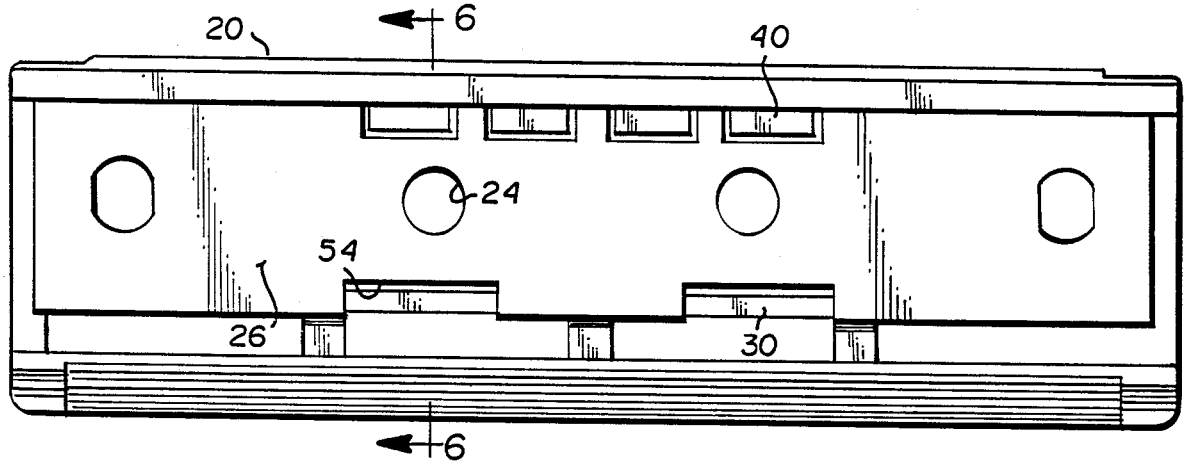
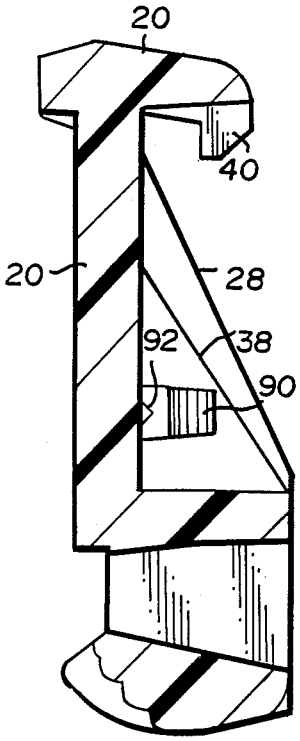
FIG. 5
FIG. 6
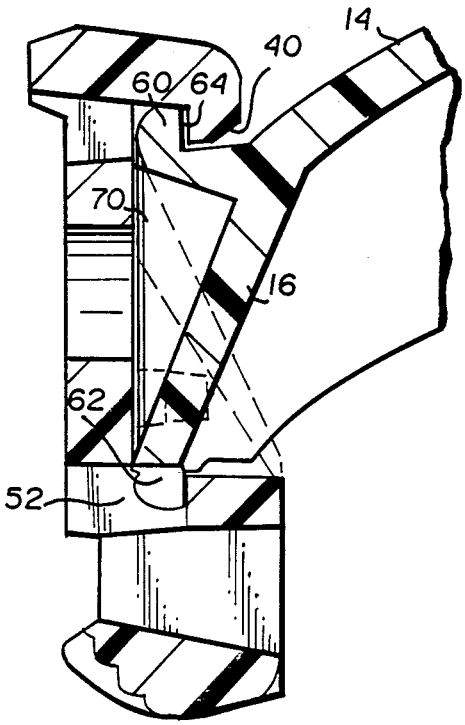

FIG. 7
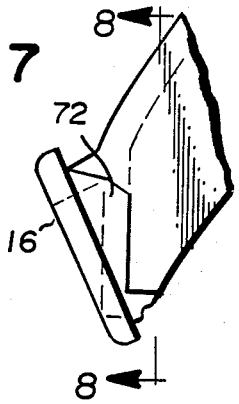
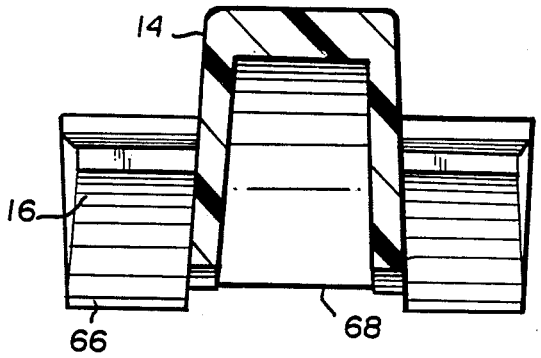
FIG. 8
FIG. 9
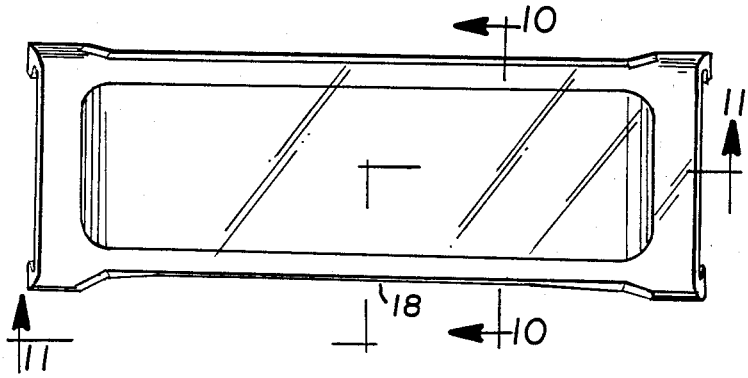
FIG. 10
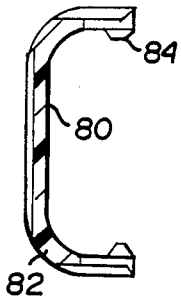
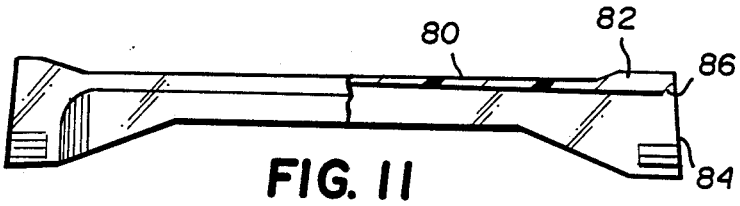
FIG. 11
FIG. 12
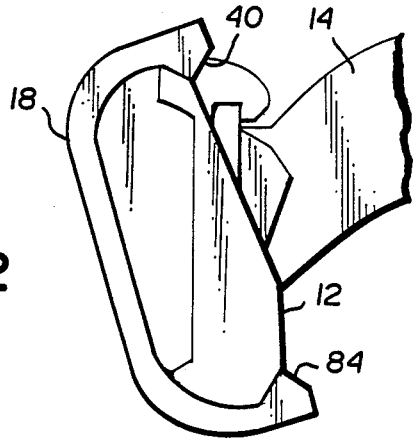

PLATFORM, HANDLE AND SHIELD FOR SAFETY RAZOR

BACKGROUND AND SUMMARY OF THE INVENTION

The present invention relates to razors, and particularly relates to a platform, handle and shield assemblage for a safety razor. More particularly, the present invention relates to novel and unique platform structure for centering the handle with respect to the platform and maintaining a tight fit therebetween, as well as a shield and platform construction for facilitating application of the shield to the platform.

Safety razors are commonly formed of a handle secured at one end to a platform, the platform in turn mounting a subassembly for carrying one or more razor blades and a cap member for retaining the blades in assembly. The razor is frequently provided with a shield to protect the user from injury resulting from inadvertent contact with the blade edge and to protect the blade edge from damage during shipping, handling, etc. The handle, platform, cap and shield are usually formed of plastic material.

In the manufacture and assembly of the various plastic parts forming disposable, relatively inexpensive safety razors, fundamental design criteria, oftentimes conflicting, must be met. For example, the connection between the handle and the platform must be secure, tight, and readily adaptable to automated processes. The parts must be capable of being molded with an economy of material without sacrificing the integrity of the design. Accurate placement of the handle vis-a-vis the platform must be facilitated. Similarly, the interconnection of the shield and the platform serving as a guard for the razor oftentimes lies off-center and it is difficult to accurately center the shield along the longitudinal extent of the platform. Hence, the shield frequently affords protection along only a portion of the length of the blade. Additionally, the shield is sometimes difficult to place on the platform without risk of injury from the blade, the same risk which the shield seeks to protect against.

According to the present invention, there is provided a novel and improved safety razor having various advantages in construction and assembly in comparison with the prior safety razors and which meets the above-noted design criteria. Particularly, the safety razor of the present invention provides a handle having a head with a pair of projections or tongues along one edge of the head. The tongues are received in undercut openings formed in a wall which projects from the underside of the razor platform. The edge of the platform opposite the wall receives the opposite edge of the handle head in a snap-fit relation. Thus, when the tongues are disposed in the undercut openings the handle may be pivoted to snap the opposite edge of the handle head past the edge of the platform to finally seat the handle head against the platform.

Features of the present invention include a pair of crush ribs which project from the underside of the platform adjacent the projecting wall for engagement along the upper surface of the handle head. As the head is pivoted into final position, it engages the crush ribs, which then serve as a fulcrum for further pivoting. When the handle head obtains final securement along the underside of the platform, the crush ribs bias the head and platform away from one another to maintain a tight fit between the handle edges on one hand and the edge of the platform and the undercuts along the platform on the other hand.

A further feature of the present invention provides for automatically centering the handle head relative to the platform when the handle and platform are pivoted relative to one another into final securement. When the tongues are received in the undercut openings in the platform, relative pivotal action between the handle and the platform locates the side edges of the handle head in engagement with a pair of centering ribs. These centering ribs have tapered surfaces which longitudinally shift the platform and handle head relative to one another in response to the pivoting action to center the platform and head.

A further feature of the present invention facilitates centering the shield with respect to the platform when it has been initially snapped onto the safety razor in an off-center position. To accomplish this, chamfers are formed along the inside end edges of the generally channel-shaped shield and also along the underside of the razor head. This enables the shield to cam upwardly against the raised end edges of the cap at either of the opposite ends of the blade head. This permits inward projections at each of the lower end corners of the shield to engage chamfered surfaces and stops along the lower corners of the platform, thus detenting the shield in a centered position. The shield is also formed symmetrically about its long axis. This facilitates orientation of the shield on the blade head during production, as well as by the consumer.

Accordingly, in one aspect of the present invention, there is provided a razor blade assemblage comprised of a razor blade handle having a head, the head having opposed edges, with one of the edges having a projection and an abutment. A platform is provided for carrying at least one razor blade on an upper side thereof, the platform having an opposite lower side. The platform also has a locking element projecting from its lower side adjacent an edge thereof for engaging the other edge of the head. A wall projects from the lower side of the platform spaced from the edge thereof and has means defining at least one opening therein for receiving the projection. The platform wall also includes a stop. The projection on the handle head is received in the wall opening with the head abutment engaging the platform stop. The platform locking element and the other edge of the head are cooperable to enable the latter edge to snap past the locking element into final locked position against the underside of the platform.

Preferably, means are carried by the platform for centering the head along the underside of the platform, as well as for biasing the head in a direction away from the platform. The centering means includes a pair of longitudinally spaced centering ribs projecting from the underside of the platform, each rib having a tapered edge for engaging the sides of the head or centering the latter when the head is applied to the platform. The biasing means includes a pair of crush ribs which serve as a fulcrum for pivoting the head and platform relative to one another to enable tight-fitting engagement between the head and handle in final assembly.

In another aspect of the present invention, a shield is provided for overlying the platform, the shield being generally co-extensive in length with the platform and generally channel-shaped in cross-section with open opposite ends. Each lower edge of the platform has a chamfered surface adjacent its opposite ends and each lower edge of the shield has a projection adjacent opposite ends thereof for engaging the chamfered surfaces of the platform for retaining the shield on the razor blade. Preferably, the end edges of the shield are tapered or chamfered to facilitate endwise centering of the shield on the platform.

Accordingly, it is a primary object of the present invention to provide a novel and improved safety razor construction and assembly having structure cooperating between the platform and handle for centering these two parts relative to one another upon their assembly and affording a tight assembly. Additionally, the shield and razor head are constructed to facilitate centering the shield on the head and detenting the shield in its centered position on the head.

These and further objects and advantages of the present invention will become more apparent upon reference to the following specification, appended drawings and claims.

BRIEF DESCRIPTION OF THE DRAWING FIGURES

FIG. 1 is a fragmentary exploded perspective view of a safety razor constructed in accordance with the present invention;

FIG. 2 is an enlarged plan view of the underside of the platform;

FIG. 3 is a cross-sectional view of the platform taken generally about on line 3—3 in FIG. 2;

FIG. 4 is a plan view of the upper surface of the platform;

FIGS. 5 and 6 are cross-sectional views taken about on lines 5—5 in FIG. 2 and 6—6 in FIG. 4, respectively;

FIG. 7 is a fragmentary side elevation view of the head on the razor handle;

FIG. 8 is a cross-sectional view thereof taken generally about on line 8—8 in FIG. 7;

FIG. 9 is a top plan view of a shield constructed in accordance with the present invention for covering the razor;

FIGS. 10 and 11 are cross-sectional views thereof taken generally about on lines 10—10 and 11—11 in FIG. 9, respectively; and FIG. 12 is a fragmentary end elevational view of the razor head with the shield applied.

DETAILED DESCRIPTION OF THE DRAWING FIGURES

Reference will now be made in detail to the present preferred embodiment of the invention, an example of which is illustrated in the accompanying drawings.

Referring now to FIG. 1, there is illustrated a safety razor, generally designated 10, having a razor blade head 12, a handle 14 carrying a handle head 16 at one end and a shield 18 for overlying razor blade head 12. Razor blade head 12 includes a platform 20 and a cap 22, between which are located one or more blades. The cap 22 and the blades form no part of the present invention and further description thereof is believed unnecessary except to note that openings 24 are formed in platform 20 to receive stakes formed along the underside of cap 22 which pass through the blades to secure the cap and blades to the platform.

Referring now to FIGS. 2–4, platform 20 comprises a base wall 26, end walls 28 which project from the underside of base wall 26, a longitudinally extending front wall 30, which similarly projects from the underside of base wall 26 and which is joined at its opposite ends by end walls 28, a rear edge 32 which projects downwardly from the underside of base wall 26 and a forward guard wall 34 connected to front wall 30 by a plurality of longitudinally spaced ribs 36. End walls 28 extend forwardly to join with the ends of guard wall 34. Extending from the back side of the front wall 30 are a pair of longitudinally spaced structural ribs 38.

The rear edge 32 includes at its lowermost portion a plurality of inwardly directed lugs 40 spaced one from the other and from the underside of base wall 26 for receiving an edge of the handle head 16, as described hereinafter. A plurality of openings 42 are formed in base wall 26 in registration with lugs 40. Rear edge 32 extends from the underside of base wall 26 in the intermediate portion of the platform and extends longitudinally short of the ends of the platform. For reasons more particularly noted hereinafter, the edges of the platform at each of its corners, i.e., the rear edges 44 and the forward corner edges 46, at the lower edge of guard 34 are chamfered. The chamfers 44 and 46 form stops 48 and 50, respectively. Also, for reasons discussed later, chamfers 51 are formed along the inside faces of projections 53 along the guard wall 34.

As part of the unique structure hereof for connecting the platform and the handle head one to the other, there is provided a pair of longitudinally spaced undercuts or openings 52 formed in front wall 30, the base wall 26 being recessed to accommodate such undercuts 52 at 54. Between undercuts 52 is a stop 53.

Referring now to FIGS. 1 and 6–8, handle 14 is formed of a plastic material and has a generally channel shape, as illustrated in FIG. 8. The handle head 16 includes opposed edges 60 and 62. Edge 60 includes an undercut locking surface 64. Edge 62 includes a pair of projections or tongues 66 located on opposite sides of handle 14, together with an abutment 68 located between the projecting tongues 66. Head 16 is also provided with a plurality of longitudinally spaced ribs 70, which extend between the edges 60 and 62 along with end ribs 72.

Referring now to FIGS. 9 through 11, there is provided a shield, preferably formed of plastic transparent material, for overlying the razor blade head 12. Preferably, the shield is generally channel-shaped in cross-section, as illustrated in FIG. 10, having base and leg portions 80 and 82, respectively. In order to detent the shield in a locked centered position with respect to the razor blade head 12, lugs 84 project inwardly from each of the legs 82 at the opposite ends of the channel-shaped shield 18. These lugs 84 cooperate with the chamfered surfaces 44 and 46 and with the stops 48 and 50 to releasably lock the shield in a centered position covering the razor blade head 12 in a manner set forth below. Additionally, to facilitate centering the shield 18 on the razor blade head 12, the end surfaces along the base and legs of shield 18 are tapered or flared outwardly and upwardly at 86, as illustrated in FIG. 11.

The manner of assembly of the handle to platform will now be described. The tongues or projections 66 on the handle head 16 are first disposed in the undercut openings 52 on platform 20 from its underside. Because of the dimensional relationship between the opposite edges of the handle head 16 and the opposite edges of rear edge 32 and front wall 30 of the platform, the tongues 66 are inserted into the undercuts 52 with the opposite edge 60 of the handle head lying outside of lugs 40. By rotating the handle, for example, in a counterclockwise direction, as illustrated in FIG. 6, using the engagement of the abutment 68 With platform stop 55 as the fulcrum, the edge 60 of the handle head 16 may be snapped past the lugs 40 to lie between the lugs 40 and the underside of base wall 26, as illustrated in FIG. 6. Thus, the locking surface 64 of the handle head engages beneath or behind the lugs 40 to retain the handle head and platform in assembled relation Note that the handle in final assembly is located between the ribs 38.

It is a significant feature of the present invention that means are provided for centering the handle with respect to the razor blade head 12, as well as for providing a tight engagement between the handle head and platform in the course of assembling the handle and platform. To accomplish this, centering ribs 88 are disposed inwardly of ribs 38, the centering ribs having tapered surfaces 90 (FIG. 5) which taper inwardly toward one another and toward the underside of base walls 26. Additionally, to maintain the tight fit between the handle head and the platform, crush ribs 92 are disposed along the underside of the base wall 26 and these project to a limited extent from such underside. The longitudinal location of the crush ribs 92 is such as to lie substantially coincident with the location of the interior ribs 70 on the handle head 16. Note also that the crush ribs 92 lie closely adjacent front wall 30.

Thus, as the handle is pivoted relative to the platform to locate the edge 60 below lugs 40, ribs 70 on the handle head engage crush ribs 92, affording fulcrums for the handle during its pivoting action. That is, the handle is first pivoted about an axis formed by abutment 68 and stop 55 until such time as the ribs 70 engage the crush ribs 92. At that time, the pivotal axis shifts to the points of engagement between crush ribs 92 and ribs 70. This engages the edges 62 against the undercuts 52, as well as tends to flex or bend handle head 16 and platform 20 to a very limited extent as the handle is pivoted to engage edge 60 below lugs 40. In this manner, the crush ribs 92 bias the handle head 16 and platform 20 for movement in a direction away from one another, causing the opposite handle head edges 60 and 62 to engage tightly against the lugs 40 and undercuts 52, respectively, of the platform.

Shield 18 may be applied over razor blade head 12 with the channel legs 82 first expanding and then contracting to lock under the long edges of the platform. If the shield 18 is not centered with respect to the razor blade head, it may be shifted longitudinally along the head to a centered position with the lugs 84 engaging the chamfered surfaces 44 and 46 and detenting behind stops 48 and 50, respectively. With the lugs at each of the four corners of the channel-shaped shield 18, the lugs will detent the shield into the proper centered position. To facilitate detenting the shield in the centered position, each tapered surface 86, as the shield slides longitudinally along the razor blade head, approaches the corresponding end of the razor blade head 12, rides up on the upstanding rib at such end of the head 12. This causes lugs 84 to engage tightly along the chamfered surfaces 44 and 46 and into their detented positions. Additionally, the lugs 84 may ride up the chamfers 51 as the shield slides longitudinally to engage stops 50. To remove the shield from head 12, the shield can simply be pivoted upwardly along one edge by displacing the shield away from head 12 along the opposite edge.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A razor assemblage comprising:

a razor blade handle having a head;

an elongated platform for carrying at least one razor blade on an upper side thereof and having an opposite lower side;

means cooperable between said platform and said head for securing said platform and said head one to the other; and means carried by said platform and said handle head cooperable to relatively displace said head and said platform in either longitudinal direction to center said head on said platform upon securement of said platform and said head one to the other, said centering means including a pair of centering ribs projecting from the underside of said platform, said head having opposed end edges, said ribs being spaced one from the other along the length of said platform and having edges tapering toward one another and said platform for engaging said end edges of said head.

2. A razor assemblage comprising:

a razor blade handle having a head, said head having opposed edges with one of said edges having a projection and an abutment;

an elongated platform for carrying at least one razor blade on an upper side thereof and having an opposite lower side;

said platform having an element projecting from said lower side adjacent a longitudinally extending edge thereof for engaging the other edge of said head opposite said one edge thereof and a wall projecting from said lower side of said platform spaced from said edge thereof and having means defining at least one opening therein for receiving said projection;

said platform wall including a stop, said projection being received in said wall opening with said abutment engaging said stop, said platform element and said other edge of said head being cooperable to enable the latter edge to snap past said element into final position against the underside of said platform in response to relative pivoting movement of said platform and said head using the engagement of said abutment and said platform stop as a fulcrum; and means carried by said platform and said handle head cooperable to center said head and said platform relative to one another in either one of opposite longitudinal directions in response to said relative pivoting movement.

3. An assemblage according to claim 2 wherein said centering means includes a pair of centering ribs projecting from the underside of said platform.

4. An assemblage according to claim 3 wherein said head has opposed end edges, said ribs being spaced one from the other along the length of said platform and having edges tapering toward one another and said platform for engaging said end edges of said head.

5. An assemblage according to claim 2 including means carried by said platform and said handle head for biasing said head and said platform for movement in a direction away from one another whereby said head and said platform are secured one to the other by engagement of said element and said other head edge and said projection and said opening defining means.

6. An assemblage according to claim 5 wherein said biasing means includes a crush rib projecting from the underside of said platform for engagement with said head.

7. A razor assemblage comprising:

a razor blade handle having a head, said head having opposed edges with one of said edges having a projection and an abutment;

an elongated platform for carrying at least one razor blade on an upper side thereof and having an opposite lower side;

said platform having an element projecting from said lower side adjacent a longitudinally extending edge thereof for engaging the other edge of said head opposite said one edge thereof and a wall projecting from said lower side of said platform spaced from said edge thereof and having means defining at least one opening therein for receiving said projection;

said platform wall including a stop, said projection being received in said wall opening with said abutment engaging said stop, said platform element and said other edge of said head being cooperable to enable the latter edge to snap past said element into final position against the underside of said platform in response to relative pivoting movement of said platform and said head using the engagement of said abutment and said platform stop as a fulcrum; and a shield for overlying the platform, said shield being generally coextensive in length with said platform and generally channel shaped in cross-section with open opposite ends, each lower edge of said platform having a chambered surface adjacent opposite ends thereof, each lower edge of said shield having a projection adjacent opposite ends thereof for engaging said chamfered surfaces for retaining the shield on said razor blade.

8. An assemblage according to claim 7 in combination with a shield for overlying the platform, said shield being generally coextensive in length with said platform and generally channel shaped in cross section with open opposite ends, the end edges of said shield being tapered to facilitate endwise centering of the shield and maintain the shield centered in final securement on said platform.

9. An assemblage according to claim 7 including means carried by said platform and said handle head cooperable to center said head along the underside of said platform, said centering means including a pair of centering ribs projecting from the underside of said platform, said head having end edges, said ribs being spaced one from the other along the length of said platform and having edges tapering toward one another and said platform for engaging said end edges of said head.

10. An assemblage according to claim 9 including means carried by said platform and said handle head for biasing said head and said platform for movement in a direction away from one another whereby said head and said platform are secured one to the other by engagement of said element and said other head edge and said projection and said opening defining means.

11. A razor assemblage comprising:

a razor blade handle;

a platform for carrying a razor blade and connected with said handle;

an elongated shield for overlying the platform, said shield being generally coextensive in length with said platform and generally channel shaped in cross section with open opposite ends, each lower edge of said platform having a chamfered surface adjacent opposite ends thereof, each lower edge of said shield having a projection adjacent opposite ends thereof for engaging said chamfered surfaces for retaining the shield on said razor blade.

12. An assemblage according to claim 11 wherein said handle has a head and said platform and said handle comprise discrete parts of the razor blade, means cooperable between said platform and said head for securing said platform and said head one to the other, including means carried by said platform and said head cooperable to center said head in either longitudinal direction along the underside of said platform.

13. An assemblage according to claim 11 wherein said handle has a head and said platform and said handle comprise discrete parts of the razor blade, means cooperable between said platform and said head for securing said platform and said head one to the other, and means carried by said platform and said head for biasing said head and said platform for movement in a direction away from one another.

14. An assemblage according to claim 11 wherein said shield is generally coextensive in length with said platform and generally channel shaped in cross section with open opposite ends, the end edges of said shield being tapered to facilitate endwise centering of the shield and maintain the shield centered in final securement on said platform.

* * * * *